United States Patent [19]

Timberlake et al.

[11] 4,414,244

[45] Nov. 8, 1983

[54] SURFACE MODIFICATION TO WAVEGUIDES

[75] Inventors: John R. Timberlake, Allentown; David N. Ruzic, Kendall Park; Richard L. Moore, Princeton; Samuel A. Cohen, Pennington; Dennis M. Manos, Lawrenceville, all of N.J.

[73] Assignee: The United States of America as represented by the U.S. Department of Energy, Washington, D.C.

[21] Appl. No.: 388,873

[22] Filed: Jun. 16, 1982

[51] Int. Cl.[3] ..... B05D 7/22; B05D 3/14; B05D 3/02

[52] U.S. Cl. ..... 427/105; 204/181 R; 427/237; 427/249

[58] Field of Search ..... 204/181 R; 427/105, 427/237, 249

[56] References Cited

U.S. PATENT DOCUMENTS

| | | | |
|---|---|---|---|
| 3,037,923 | 6/1962 | Gnau | 204/181 |
| 3,945,898 | 3/1976 | Tsuji et al. | 204/181 |

OTHER PUBLICATIONS

Dorofeyuk et al., "Electron Discharge in the Interaction of Microwave Radiation with a Metal Surface", Sov. Phys. Tech. Phys., vol. 21, No. 1, Jan. 1976, pp. 76–80.

Timberlake et al., Abstract of "Surface Modification of PLT Lower Hybrid Waveguides to Improve Operations", Jun. 18, 1981.

*Primary Examiner*—James R. Hoffman

*Attorney, Agent, or Firm*—Jeannette M. Walder; Walter L. Rees; Richard G. Besha

[57] ABSTRACT

A method of treating the interior surfaces of a waveguide to improve power transmission comprising the steps of mechanically polishing to remove surface protrusions; electropolishing to remove embedded particles; ultrasonically cleaning to remove any residue; coating the interior waveguide surfaces with an alkyd resin solution or electrophoretically depositing carbon lamp black suspended in an alkyd resin solution to form a 1μ to 5μ thick film; vacuum pyrolyzing the film to form a uniform adherent carbon coating.

9 Claims, No Drawings

SURFACE MODIFICATION TO WAVEGUIDES

CONTRACTUAL ORIGIN OF THE INVENTION

The U.S. Government has rights in this invention pursuant to Contract No. DE-AC02-76-CH03073 between the U.S. Department of Energy and Princeton University.

BACKGROUND OF THE INVENTION

This invention relates to surface modifications to waveguides to improve power transmission, and more particularly to an improved method of applying a highly adherent carbon coating to the waveguide interior. The waveguide is a standard means for transmitting electromagnetic energy. In the development of a nuclear fusion reactor, waveguides are used for transmitting radiofrequency (RF) energy to the plasma for heating and for driving current. A very large amount of power must be transmitted to the plasma before sustained nuclear fusion can occur. The waveguides used on the PLT (Princeton Large Torus) for lower hybird heating and current drive experiments are made of stainless steel and are subject to high power (greater than 80 KW) RF breakdown. The waveguides used for ion cyclotron resonance frequency (ICRF) experiments are made of copper and experience similar breakdown. Factors contributing to this breakdown are gas evolved from waveguide walls, electron multipaction, photoelectron emission and arcing. In addition to eliminating or suppressing these breakdown factors, a coating suitable for use on a treated waveguide for transmitting power to a plasma must also have a low Z (atomic number) and be operable near the high magnetic fields confining the plasma.

Due to its low Z, adsorbed gas free surface, low secondary electron yield, carbon is a desirable coating material, but prior are methods of producing carbon coatings have not proven satisfactory. Deposition of soot from acetylene and propane rich flames produces non-uniform thickness and poor adhesion. Coatings produced by pyrolysis of commercial carbon rich paints have uniform thickness but poor adhesion. Coatings produced by heating a film formed by electrodepositing carbon suspended in a water soluble resin are too thick, resulting in power attenuation in a waveguide. Furthermore, methods that use water based products result in oxide formations which reduce conductivity.

Therefore, it is an object of the present invention to provide a method of treating the interior surfaces of a waveguide to improve power transmission.

It is another object of the present invention to provide a method of producing a thin, durable carbon coating with good adherence and good uniformity.

It is yet another object of the present invention to treat waveguide surfaces to improve resistance to to high power RF breakdown.

Additional objects, advantages and novel features of the invention are set forth in part in the description which follows, and in part will become apparent to those skilled in the art upon examination of the following or may be learned by practicing the invention.

SUMMARY OF THE INVENTION

To achieve the foregoing objects a method of treating the interior surfaces of a waveguide comprises the steps of mechanicaly polishing the interior surfaces to remove surface protrusions greater than 0.001 inch, electropolishing the interior surfaces to remove embedded particles and reduce surface roughness, ultrasonically cleaning the interior surfaces to remove any residue, coating the interior surfaces with an alkyd resin solution or electrophoretically despositing carbon lamp black suspended in an alkyd resin solution, to form a 1μ–5μ thick film, and vacuum pyrolyzing the film to form a uniform, adherent carbon coating on the interior waveguide surfaces. Preferably, only non-aqueous solutions or media are used in the various steps of the invention to minimize oxide formations, which make the coating non-conductive. Vacuum pyrolyzing is used to remove adsorbed gases, rather than applying heat in a conventional pyrolysis step. The basic criteria for the adherence of the carbon coating is its resistance to pulling off with cellophane tape. The present invention results in uniform, highly adherent carbon coatings, which are thick enough to improve resistance to RF breakdown, yet thin enough to increase the waveguides power transmission.

BRIEF DESCRIPTION OF THE DRAWINGS

There are no drawings describing the present invention.

DETAILED DESCRIPTION OF THE INVENTION

The present invention describes a waveguide treatment program to improve resistance to high power RF breakdown by producing a smooth, clean, conducting surface. The method is especially applicable to stainless steel and copper wave-guides used on plasma confinement devices.

The first step in the present invention is mechanical polishing to remove surface roughness greater than 0.001 inches. Mechanical polishing is followed by electropolishing with a suitable electrolyte solution. In order to minimize oxide formations, a non-aqueous electrolyte is recommended. Electropolishing removes embedded grit from the mechanical polishing and reduces surface roughness, thereby reducing the surface area available for adsorbed gases. Electropolishing also has the effect of reducing photoelectron yield and lowering secondary electron emissivity. After electropolishing the waveguide is ultrasonically cleaned. A preferred solvent is xylene, which is used in the carbon film process.

After ultrasonic cleaning a 1μ–5μ thick film of an alkyd resin solution is applied to the interior waveguide surfaces. Preferably, a 50% solution by volume of xylene and an alkyd resin is used. The air dried film is then vacuum pyrolyzed to form a uniform carbon coating. Thicker coatings can be produced by applying additional coats of the solution and again vacuum pyrolyzing. It was found that a 50% solution by volume of xylene and an alkyd resin was viscous enough to produce a 1μ thick film which vacuum pyrolyzed to a 300 Å thick carbon coating that satisfied the adherence criterion.

Thicker carbon coatings can also be obtained by electrophoresis. Lamp black ultrasonically dispersed in the 50% alkyd resin/xylene solution produced 5μ thick films after air drying. After vacuum pyrolyzing this produced a 1400 Å thick carbon coating which satisfied the adherence criterion.

EXAMPLE

The PLT lower hybrid waveguides are 304 stainless steel with brazed joints. Treatments above 425° C. were not considered since they result in carbide formation in steel and weakening of brazed joints.

Due to size contraints on the PLT waveguide array, to accomplish the mechanical polishing an apparatus was constructed that had a rotating disk that extended to within 2 mm of the interior edges of the waveguide and could be driven the entire length of the waveguide. When the waveguides chamber walls were polished horizontally, the down side surface of the chamber was polished as the disk traversed its length, loaded with approximately 1 lb. of force. The PLT waveguide chamber walls were polished with 10 passes of 120 second duration each with 120 grit and 240 grit, followed by 5 passes of 320 grit. The edges which would be in closest proximity to the plasma were hand lapped with 600 grit. This process removed surface protrusions greater than 0.001 inch. The waveguide was electropolished for twenty minutes at approximately 3 volts and 2.5 A/dm$^2$. Electropolishing was followed by ultrasonic cleaning for one half hour. A 50% solution by volume of xylene and Glyptal (an alkyd resin manufactured by General Electric) was applied to the waveguide, which air dried to a 1$\mu$ thick film. The film was vacuum pyrolyzed at 400° C. to form a 300 Å thick carbon coating which satisified the cellophane tape adherence test. The treated waveguide in full operation transmitted three times the power to the plasma as did the untreated waveguide.

The embodiments of this invention in which an exclusive property or privilege is claimed are defined as follows:

1. A method of treating the interior surfaces of a waveguide comprising the steps of:

(a) mechanically polishing the interior waveguide surfaces to remove surface protrusions;

(b) electropolishing the interior waveguide surfaces with an electrolyte to produce an electrochemically flat surface;

(c) ultrasonically cleaning the interior waveguide surfaces with a solvent to remove any residue;

(d) applying a 1$\mu$–5$\mu$ thick film of an alkyd resin solution to the interior waveguide surfaces; and (e) vacuum pyrolyzing said film to form a carbon coating.

2. The method of claim 1 wherein the mechanical polishing removes surface protrusions greater than 0.001 inch.

3. The method of claim 1 wherein said alkyd resin solution comprises 50% by volume of xylene and 50% by volume of an alkyd resin.

4. The method of claim 2 or 3 wherein steps d and e are repeated a sufficient number of times to form a carbon coating 300 Å to 1400 Å thick.

5. The method of claim 1 wherein the 1$\mu$–5$\mu$ thick film is formed by electrophoretic deposition of carbon lamp black suspended in a solution of 50% by volume of xylene and 50% by volume of an alkyd resin.

6. The method of claim 1 wherein the electolyte is non-aqueous.

7. The method of claim 1 wherein the solvent is xylene.

8. The method of claim 1 wherein the interior waveguide surfaces are formed of stainless steel and the film is vacuum pyrolyzed at a temperature not greater than 400° C.

9. The method of claim 1 wherein the interior waveguide surfaces are formed of copper and the film is vacuum pyrolyzed at a temperature not greater than 400° C.

* * * * *